US009776746B2

(12) United States Patent
Tellen et al.

(10) Patent No.: US 9,776,746 B2
(45) Date of Patent: Oct. 3, 2017

(54) PROCESS AND APPARATUS FOR WRAPPING A STACK OF GOODS IN FILM

(71) Applicant: BEUMER GmbH & Co. KG, Beckum (DE)

(72) Inventors: Marc Tellen, Fürchtorf (DE); Dirk Göbel, Wadersloh (DE); Andreas Weitenberg, Beckum (DE)

(73) Assignee: BEUMER GmbH & Co. KG, Beckum (DE)

( * ) Notice: Subject to any disclaimer, the term of this patent is extended or adjusted under 35 U.S.C. 154(b) by 735 days.

(21) Appl. No.: 14/050,407

(22) Filed: Oct. 10, 2013

(65) Prior Publication Data

US 2014/0102046 A1 Apr. 17, 2014

(30) Foreign Application Priority Data

Oct. 12, 2012 (DE) ..... 10 2012 019 988

(51) Int. Cl.
*B65B 11/02* (2006.01)
*B65B 9/13* (2006.01)

(52) U.S. Cl.
CPC ..... *B65B 11/02* (2013.01); *B65B 9/135* (2013.01)

(58) Field of Classification Search
CPC .. B65B 9/135; B65B 9/14; B65B 9/13; B65B 11/02; B65B 11/10; B65B 59/04; B65B 5/022; B65B 43/34; B65B 43/08; B65B 11/585
USPC ..... 53/461, 218, 441, 459, 556, 567, 588, 53/393
See application file for complete search history.

(56) References Cited

U.S. PATENT DOCUMENTS 3,735,557 A * 5/1973 Hoffarth ..... B65B 9/135 53/386.1
3,823,527 A * 7/1974 Burn ..... B65B 9/135 53/389.2
3,852,937 A * 12/1974 Bitsura ..... B65B 9/135 53/386.1

(Continued)

FOREIGN PATENT DOCUMENTS

DE 8533302.6 9/1987
DE 3822241 9/1989

(Continued)

OTHER PUBLICATIONS

Search Report for corresponding Application No. DE 10 2012 019 988.0 dated May 28, 2013.

*Primary Examiner* — Thanh Truong
*Assistant Examiner* — Thomas Wittenschlaeger
(74) *Attorney, Agent, or Firm* — Renner, Otto, Boisselle & Sklar, LLP

(57) ABSTRACT

A process for wrapping a stack of goods in film, wherein a portion of film is drawn from a film supply, cut, opened by a film opening means and pulled over the stack of goods by a travelling pulling means, wherein, after being drawn off and cut, the portion of film is transported lengthwise by a film transport means to the film opening means, characterized in that the portion of film is transported from the cutting unit as far as the film opening means by being gripped by frictional engagement between at least two conveyor members pressed together and circulating endlessly in a transport direction.

13 Claims, 4 Drawing Sheets

(56) References Cited

U.S. PATENT DOCUMENTS

| | | | | |
|---|---|---|---|---|
| 3,897,674 | A * | 8/1975 | Higgins | B65B 9/135 53/567 |
| 4,050,219 | A * | 9/1977 | Higgins | B65B 9/135 53/567 |
| 7,802,416 | B2 * | 9/2010 | Drolet | B65B 5/022 53/441 |
| 7,913,476 | B2 | 3/2011 | Lachenmeier | |
| 7,966,790 | B2 * | 6/2011 | Michels | B65B 9/135 53/441 |
| 2006/0243015 | A1 * | 11/2006 | Habermann | B21B 13/06 72/249 |

FOREIGN PATENT DOCUMENTS

| | | |
|---|---|---|
| DE | 3918311 | 12/1989 |
| DE | 60024523 | 8/2006 |

* cited by examiner

PROCESS AND APPARATUS FOR WRAPPING A STACK OF GOODS IN FILM

CROSS-REFERENCE TO RELATED APPLICATION

The present application claims benefit of and priority under 35 U.S.C. §119 to German Application No. 10 2012 019 988.0, filed Oct. 12, 2012, the entirety of which is hereby incorporated herein by reference.

TECHNICAL FIELD

The invention relates to a process and an apparatus for wrapping a stack of goods in film, wherein a portion of film is drawn from a film supply in a film take-off apparatus, cut off with cutting means, optionally welded into a film shroud, opened by a film opening means and pulled over the stack of goods by a travelling pulling means.

BACKGROUND

Many types of processes and apparatuses of this kind are known in the state of the art, such as in DE 39 18 311 A1. In packaging apparatuses of this kind with a conventional construction, the apparatus elements needed for drawing off, cutting and, where applicable, welding the film are fixedly located inside or on a hoist frame in the form of a shroud head above a pulling means. These parts require maintenance at regular intervals and may need to be repaired unexpectedly. In order for this work to be performed, a working platform to the side of the hoist frame is needed.

EP 2 069 206 B1 proposed disposing the apparatus elements mentioned ("shroud head") so as to travel vertically and to lower them for the purposes of maintenance and repair. This, however, requires a complex travelling and locking mechanism and entails the additional disadvantage that the apparatus elements cannot be lowered if there is a stack of goods located inside the apparatus.

It is known from DE 600 24 523 T2 to wind a cut-off portion of film onto a storage drum and to position the latter above the stack of goods with a robot arm, where the film is then unwound again. A discontinuous method of working of this kind is unfavourable when the packing procedures are taking place in quick succession.

DE 85 33 302 U1 discloses an apparatus for slipping a shrinkable shroud over goods for packaging, in which a vertically movable transport carriage is provided on a frame and can grip a front end of the shroud, pull the shroud upwards and then travel downwards to take over the next shroud. DE 38 22 241 C1 discloses a similar apparatus, in which grippers that can be moved to and fro are provided in order to move the shroud upwards and over the goods for packaging, wherein the grippers are then moved back in the opposite direction to their original transport direction. In both cases, the discontinuous method of working is a disadvantage.

SUMMARY

The invention has set itself the objective of solving the above-mentioned problems.

First of all, a process for wrapping a stack of goods in film, wherein a portion of film is drawn from a film supply, cut off, opened by a film opening means and pulled over the stack of goods by a travelling pulling means, wherein, after being drawn off and cut, the portion of film is transported lengthwise by a film transport means to the film opening means, characterised in that the portion of film is transported from the cutting unit as far as the film opening means by being gripped by frictional engagement between at least two conveyor members pressed together and circulating endlessly in a transport direction, is proposed for this purpose.

In contrast to most conventional wrapping processes, it means that at least the drawing off of the portion of film from the film supply and cutting it do not take place in a shroud head above an initial sheathing height, i.e. above the stack of goods, but rather below the initial sheathing height, whereupon the cut-off portion of film is transported lengthwise by a film transport means provided specifically for that purpose up to or above the required initial sheathing height, to a film opening means, so that the latter can grip the portion of film, open it and pass it on to the pulling means, which then pulls it out of the stack.

Thanks to the method of working, which is continuous in contrast to the state of the art, and in combination with a lower height at which the drawing off and cutting are performed, time benefits are achieved, and it is considerably easier to intervene in order to carry out maintenance or repair work.

The invention contemplates that by moving the pulling means, a lower film edge is expeditiously pulled from an initial sheathing height up to a final sheathing height, wherein the portion of film below the initial sheathing height is drawn from the film supply and cut, and is transported by the film transport means at least up to the initial sheathing height.

It is preferably contemplated that the portion of film below the initial sheathing height is welded into a film shroud which is closed on one side. Since the welding process can also be performed at a lower height compared to the state of the art, any maintenance or repair work that might be needed here is likewise considerably easier to carry out.

It is contemplated that the portion of film within a film preparation region, which extends from below the final sheathing height to no more than 50% or 75% of the initial sheathing height, is conveniently drawn off and/or cut and/or welded. Since it is helpful if an operator or maintenance staff can easily reach the apparatus elements needed for carrying out the drawing-off, cutting and welding processes, it is convenient for these to be located in the region of a workshop level, so that it is particularly advantageous if the portion of film is drawn off and/or cut and/or welded at a height of no more than 1 m, 1.5 m or 2 m above a workshop level of a wrapping apparatus with which the process is performed.

It goes without saying that the elements mentioned are also located below the final sheathing height or below the workshop level, for example sunk into an easily accessible pit provided for that purpose, which may be covered so that people can walk on it or workshop vehicles can drive across it, in order to save space. It may also be contemplated that the portion of film is drawn off, cut and delivered to the film transport means in the region of a first storey of a multistorey unit, wherein the stack of goods to be wrapped and the film-opening and pulling means are located in the region of a second storey disposed above or below the first storey.

It is convenient for the portion of film to be conveyed in a vertical direction up to or above the initial sheathing height, and then in a horizontal direction until it is over the pulling means.

The portion of film is preferably formed from stretch film and is stretched in the transverse direction before being pulled over, for example by at least 15%, 20%, 30%, 50% or 75% of its original dimensions in the unstretched state.

In addition, it is possible for a predetermined length of film and/or a plurality of cut portions of film to be provisionally stored by the film transport means before being opened and supplied to the pulling means. In this case, the film transport means may have a greater length than is required for the mere transport between where the film is drawn off, cut and, where applicable, welded and opened.

The invention further relates to an apparatus for wrapping an item in a film, especially for carrying out the process of the invention, with a film supply, a film take-off apparatus for drawing off a portion of film, a cutting means for cutting the portion of film off the film supply, a film opening means for gripping and opening the portion of film, and a pulling means, is movable between an initial sheathing height (H) and a final sheathing height (h), wherein a film transport means is disposed between the cutting means and the film opening means, said film transport means being configured to transport the cut-off portion of film lengthwise to the film opening means, characterised in that the film transport means comprises a first endlessly circulating conveyor member and a second endlessly circulating conveyor member pressed against the first conveyor member, both of which can be driven in a transport direction and between which the portion of film is receivable by frictional engagement by the cutting means as far as the film opening means.

It is contemplated that the film transport means conveniently extends from below the final sheathing height to at least the initial sheathing height.

A welding means is preferably arranged below the initial sheathing height to form a film shroud which is closed on one side.

The film take-off apparatus and/or the cutting means and/or the welding means may be disposed within a film preparation region, which extends from below the final sheathing height to no more than 50% or 75% of the initial sheathing height.

It is preferably contemplated that the film take-off apparatus and/or the cutting means and/or the welding means is/are disposed at a height of no more than 1 m, 1.5 m or 2 m above a workshop level on which the apparatus is located, or optionally below the workshop level, as explained above.

It is also possible that the film supply, the film take-off apparatus and, where applicable, the cutting means is/are disposed in the region of a first storey of a multistorey unit and the stack of goods to be wrapped and the film-opening and pulling means are disposed in the region of a second storey located above or below the first storey.

The first conveyor member may comprise two or more first conveyor part-members, and the second conveyor member may comprise two or more second conveyor part-members.

The film transport means may comprise an entry region, a vertical conveying region which extends up to or above the initial sheathing height, and an—especially horizontal—transfer region adjoining it, which extends to above the pulling means. The vertical conveying region may be disposed inside or outside a hoist frame of the apparatus, wherein the hoist frame may comprise two or four vertical supports on which the pulling means is guided vertically.

The horizontal transfer region may at its end comprise a delivery region pointing vertically downwards.

The film transport means is preferably equipped with two endlessly circulating conveyor members in the form of belts, straps, toothed belts, flat belts, round belts, chains, link belts or the like. Alternatively, the film transport means may be formed in sections, each consisting of two endlessly circulating conveyor members pressed against each other, for example with a first pair of conveyor members for a vertical conveying region and a second pair of conveyor members for a horizontal transfer region.

The film transport means may be configured to transport the portion of film up to a film transfer height, which is located a handling distance above the initial sheathing height, wherein the handling distance can correspond to at least a height of a film opening means.

In one variant, the film transport means may be configured as a film storage unit, or as an additional film storage unit, in which a predetermined length of film and/or a plurality of cut-off portions of film can be stored. For this purpose, the film transport means may be guided through detours, such as in a plurality of sections running parallel and opposite to one another, in order to reach a predetermined overall length.

By providing for the interim storage of film and/or portions of film, time savings can be achieved in the case of wrapping processes performed in series, one after the other.

BRIEF DESCRIPTION OF THE DRAWINGS

The invention will now be explained by describing a worked embodiment, reference being made to a drawing, in which.

DETAILED DESCRIPTION

Figure 1:
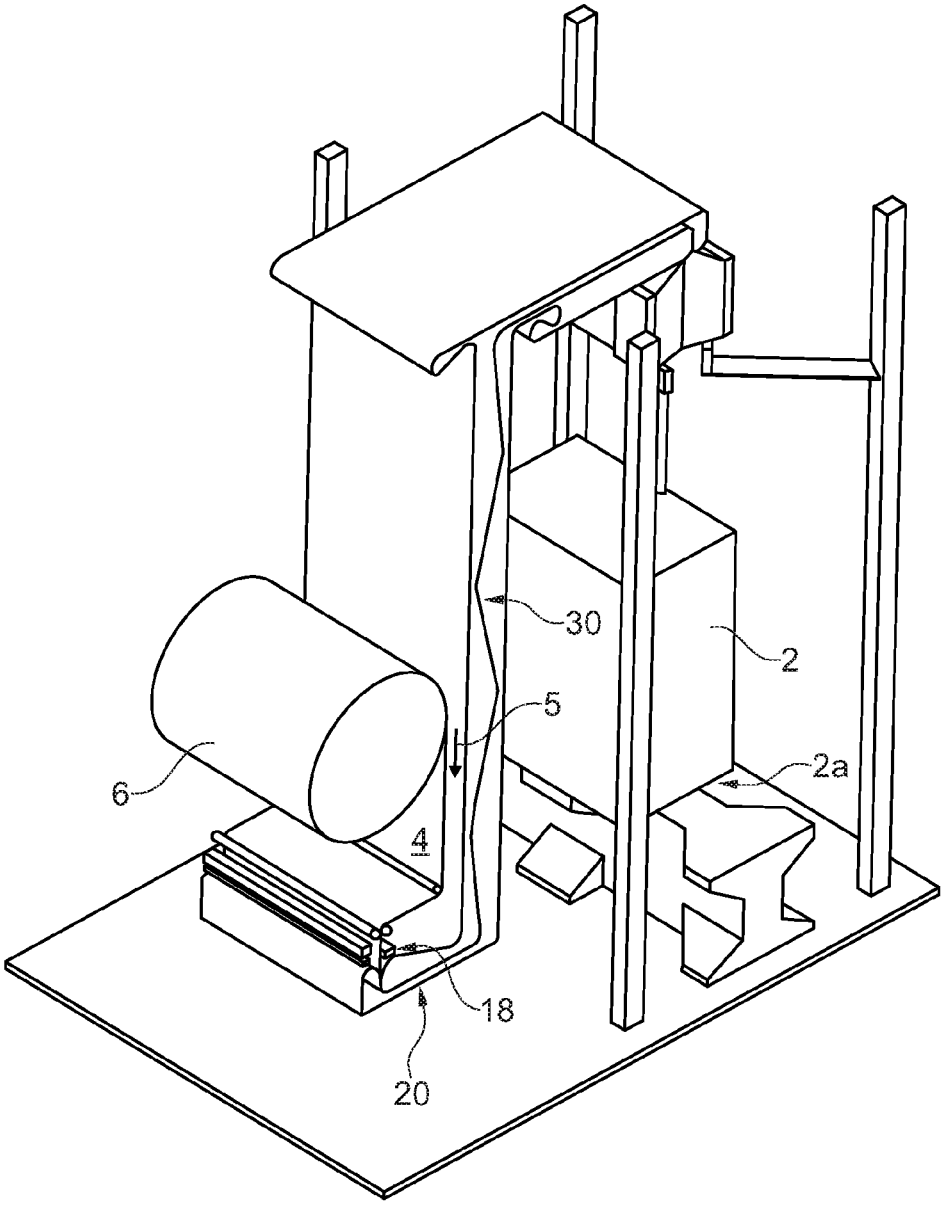
FIG. 1 shows a perspective view of an apparatus in accordance with the invention.

The illustrations show an apparatus which is known in principle for pulling a stack of goods 2 into a wrapping film 4, which nowadays is usually a stretch film, in contrast to the shrink film which was generally used in the past, and which had to be placed on the stack of goods with the application of heat.

The apparatus has a mount, which is not illustrated in detail, for holding a roll of film 6, which forms a store of wrapping film 4, wherein the film is often wound up in the form of a gusseted tubular film.

A return roller 8 and a pair of feed rollers 10 are illustrated as examples of a film take-off apparatus which can be controlled in order to draw off a portion of film of predetermined length. Seen in the unwinding direction 5 of the wrapping film 4, a cutting means 12 is provided beneath the film take-off apparatus 8, 10, with a knife arranged transversely to the film and a welding means 14 with welding bars 14*a, b* arranged on both sides of the film.

Beneath the cutting and welding means 12, 14 there is an entry region 18, pointing vertically downwards, of a film transport means 20, which works in a transport direction 21 and consists substantially of two conveyor members in the form of conveyor belts 22, 24, which are at least in parts pressed together within a conveying region which begins with the entry region 18 and ends with a delivery region 26. The film transport means transports, lengthwise, the cut portion of film, which is welded on one side, wherein a longitudinal direction of the portion of film is the same as the transport direction 21.

Figure 4:
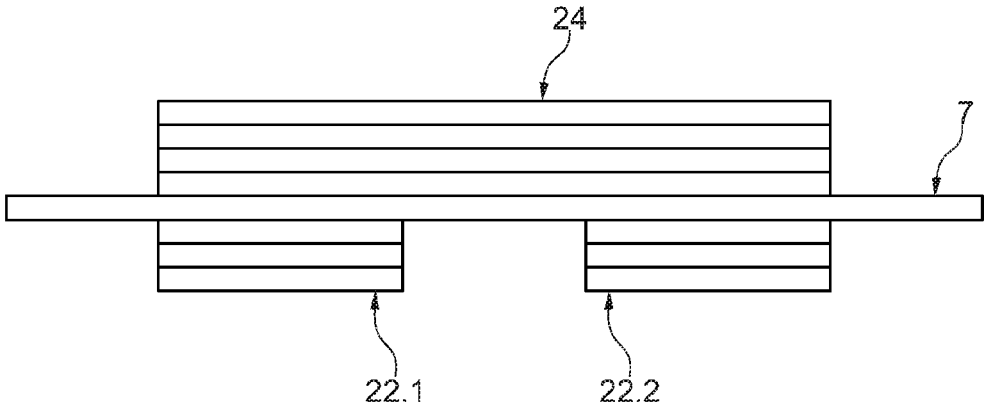
FIG. 4 shows an embodiment in a variant with two conveyor part-members.

FIG. 4 shows schematically that the film transport means can consist not only of two conveyor members, but that each conveyor member may be formed from two or more conveyor part-members, which complement one another. It is for example possible, as shown in FIG. 4, for a first conveyor member to consist of two first conveyor part-members 22.1, 22.2, which may, for example, be configured as conveyor belts or part conveyor belts and face a unitary second conveyor member 24 in the form of a conveyor belt, wherein a portion of film 7 is received by frictional engagement between the conveyor members or conveyor part-members when they are pressed together. The conveyor members or conveyor part-members need not necessarily be conveyor belts, but rather rollers, grippers or suction elements under a partial vacuum, suction belts or the like may also be used.

In the embodiment illustrated, the entry region 18 is first followed by a horizontal conveying region 28, in which the conveyor belts 22, 24 run substantially horizontally. Adjoining the horizontal conveying region 28 is a conveying region 30 running vertically upwards, in the course of which the adjacent conveyor belts 22, 24 are deflected more than once around horizontal return rollers 32 in alternating directions deviating slightly from the vertical, so that the conveyor belts 22, 24 are as far as possible pressed together over a great part of or the entire length of the vertical conveying region 30.

Adjoining the vertical conveying region 30 is a horizontal transfer region 34, which ends with the delivery region 26 pointing vertically downwards inside a hoist frame 36 of the apparatus. The delivery region 26 is located above a film opening means 40, which includes means for gripping and opening the film.

Figure 2:
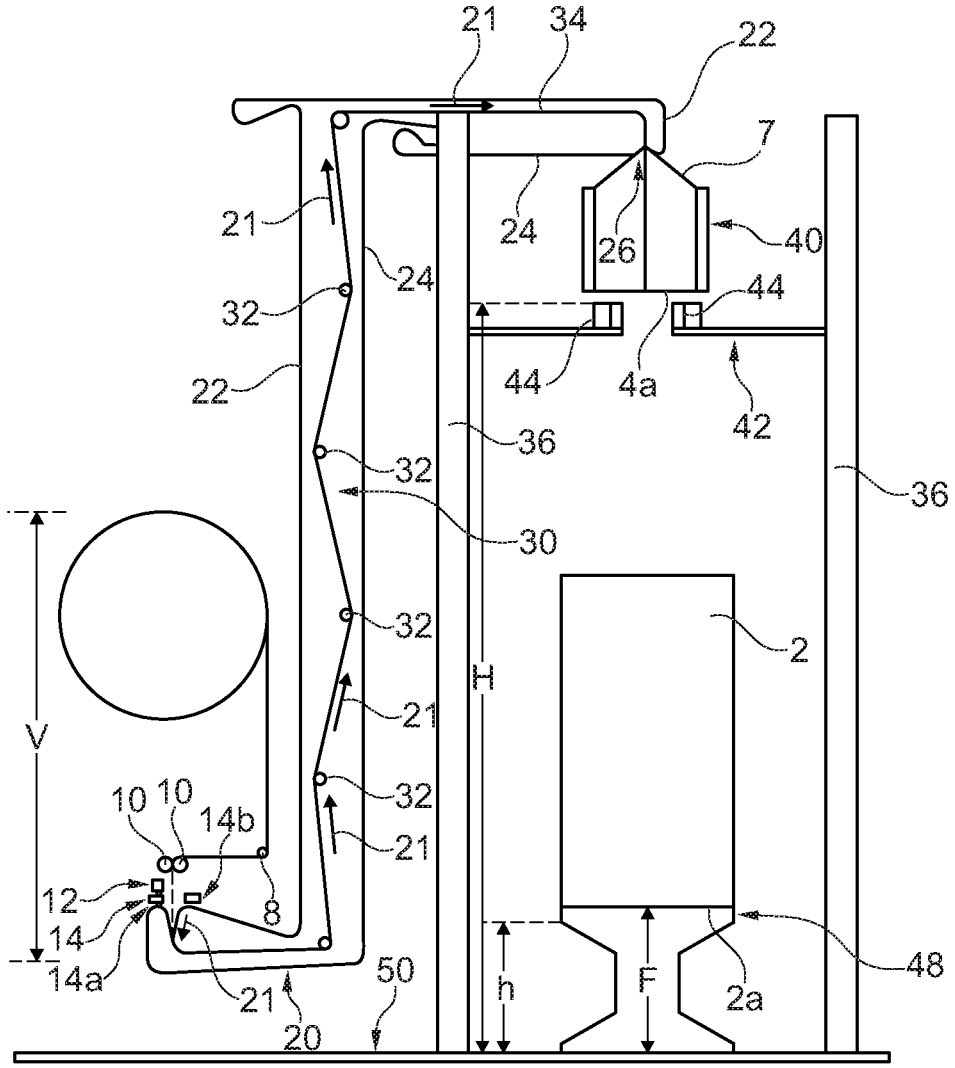
FIG. 2 shows a schematic side view of the apparatus of FIG. 1.
Figure 3:
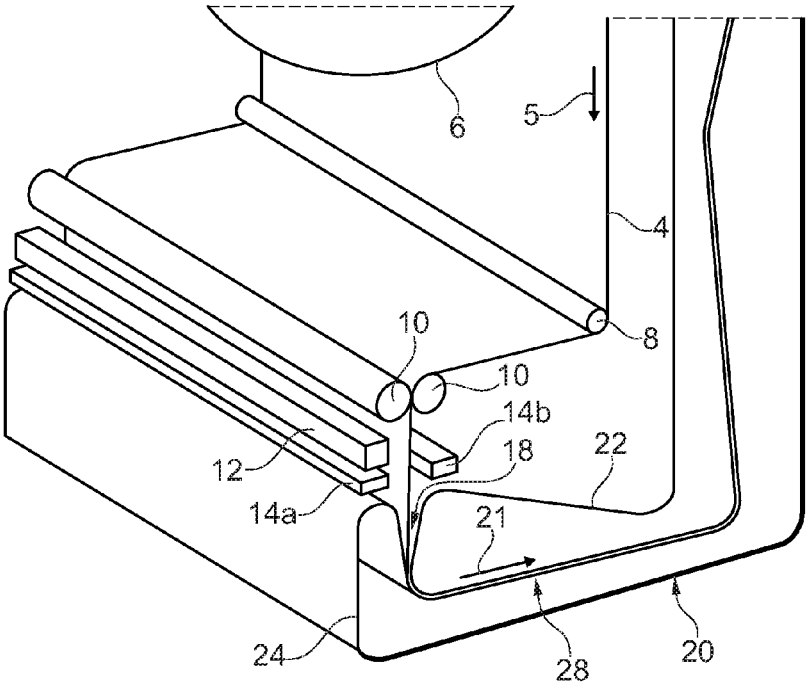
FIG. 3 shows an enlarged excerpt from FIG. 1.

Beneath the film opening means 40, which is joined firmly to the hoist frame 36, there is a pulling means 42 which travels vertically and which, in the embodiment illustrated, has four reefing hoops 44 arranged in the corners of a square or rectangle to take up and reef a portion of film. The pulling means 42 can travel vertically between an initial sheathing height H illustrated in FIGS. 1 and 2 up to a final sheathing height h, in order to pull a cut portion of film over the stack of goods 2.

The initial sheathing height H is dimensioned such that a stack of goods 2 with the greatest possible height can be processed by the apparatus with no difficulty, while the final sheathing height h is just below a bottom edge 2*a* of a stack 2, so that if needed, the film can be pulled over the stack with an "understretch", reaching beneath the bottom edge 2*a*.

The stack of goods 2 itself is located on a conveying means 48 spaced a vertical distance F above a workshop level 50 on which the apparatus is arranged and from where work can be carried out on the apparatus, such as maintenance or repair work and replacing the roll of film 6.

In order for work to be carried out on the feed rollers 10, the cutting means 12 and the welding means 14 and for the roll of film 6 to be replaced in a simple manner, e.g. by an operator standing on the workshop level 50, the apparatus elements mentioned should not be located higher than for example 1.5 m above the workshop level 50, so that it can be accessed with no difficulty. The roll of film 6 may be arranged higher, such as up to 2 m or even higher, because it is not usually moved by an operator directly, but rather by means of a transport device, such as a fork-lift truck.

Irrespective of whether a workshop level 50 is available as the "reference level" for favourable positioning of the take-off apparatus and cutting and welding means, substantial benefits are available if the equipment referred to is located below the initial sheathing height H, namely expeditiously within a film preparation region V, which extends from below the final sheathing height h to no more than 50% or 75% of the initial sheathing height H.

LIST OF REFERENCE NUMERALS

2 stack of goods
2*a* bottom edge
4 film
4*a* lower film edge
5 unwinding direction
6 roll of film (film supply)
7 portion of film
8 return roller
10 feed rollers
12 cutting means
14 welding means
14*a, b* welding bar
18 entry region
20 film transport means
21 transport direction
22 first conveyor belt (conveyor member)
22.1, 22.2 first part conveyor belt (conveyor part-member)
24 second conveyor belt (conveyor member)
26 delivery region
28 horizontal conveying region
30 vertical conveying region
32 return rollers
34 transfer region
36 hoist frame
40 film opening means
42 pulling means
44 reefing hoop
48 conveying means
50 workshop level
H initial sheathing height
h final sheathing height
F distance between 48 and 50
V film preparation region

The invention claimed is:

1. An apparatus for wrapping a stack of goods in a film, with a film supply, a film take-off apparatus for drawing off a portion of film, a cutting means for cutting the portion of film off the film supply, a film opening means for gripping and opening the portion of film, and a pulling means that is movable between an initial sheathing height (H) and a final sheathing height (h), wherein a film transport means is disposed between the cutting means and the film opening means, said film transport means being configured to transport the cut-off portion of film lengthwise to the film opening means, wherein the film transport means comprises a first endlessly circulating conveyor member and a second endlessly circulating conveyor member pressed against the first conveyor member, both of which can be driven in a transport direction and between which the portion of film is receivable by frictional engagement from the cutting means as far as the film opening means, wherein the film transport means, with the film received in the frictional engagement between the first endlessly circulating conveyor member and the second endlessly circulating conveyor member, transports the film from below the final sheathing height (h) to at least the initial sheathing height (H).

2. The apparatus as claimed in claim 1, wherein a welding means is arranged below the initial sheathing height (H) to form a film shroud which is closed on one side.

3. The apparatus as claimed in claim 2, wherein the film take-off apparatus and/or the cutting means and/or the welding means is/are disposed within a film preparation region (V), which extends from below the final sheathing height (h) to 75% of the initial sheathing height (H).

4. The apparatus as claimed in claim 2, wherein the film take-off apparatus and/or the cutting means and/or the welding means is/are disposed at a height of no more than 2 m above a workshop level on which the apparatus is located.

5. The apparatus as claimed in claim 1, wherein the film supply, the film take-off apparatus and the cutting means are disposed in a first region of a multistorey unit, and the stack of goods to be wrapped and the film-opening and pulling means are disposed in a second region located above or below the first region.

6. The apparatus as claimed in claim 1, wherein the first conveyor member comprises two or more first conveyor part-members.

7. The apparatus as claimed in claim 1, wherein the second conveyor member comprises two or more second conveyor part-members.

8. The apparatus as claimed in claim 1, wherein the film transport means has an entry region, a vertical conveying region which extends up to or above the initial sheathing height (H), and a transfer region adjoining it, which extends to above the pulling means.

9. The apparatus as claimed in claim 1, wherein the transfer region comprises at its end a delivery region within which a portion of the film is transferred vertically downwards.

10. The apparatus as claimed in claim 1, wherein the film transport means is configured to transport the portion of film up to a film transfer height, which is located a handling distance above the initial sheathing height (H), wherein the handling distance corresponds to at least a height of the portion of film on the pulling means.

11. The apparatus as claimed in claim 1, wherein the film transport means is configured as a film storage unit, in which a predetermined length of film and/or a plurality of cut-off portions of film can be stored.

12. An apparatus for wrapping a stack of goods in a film, with a film supply, a film take-off apparatus for drawing off a portion of film, a cutting means for cutting the portion of film off the film supply, a film opening means for gripping and opening the portion of film, and a pulling means that is movable between an initial sheathing height (H) and a final sheathing height (h), wherein a film transport means is disposed between the cutting means and the film opening means, said film transport means being configured to transport the cut-off portion of film lengthwise to the film opening means, wherein the film transport means comprises a first endlessly circulating conveyor member and a second endlessly circulating conveyor member pressed against the first conveyor member, both of which can be driven in a transport direction and between which the portion of film is receivable by frictional engagement from the cutting means as far as the film opening means, wherein the first endlessly circulating conveyor member and the second endlessly circulating conveyor member, pressed together with the portion of film between, run continuously between the cutting means from below the final sheathing height (h) to the film opening means at or above the initial sheathing height (H).

13. An apparatus for wrapping a stack of goods in a film, with a film supply, a film take-off apparatus for drawing off a portion of film, a cutting means for cutting the portion of film off the film supply, a film opening means for gripping and opening the portion of film, and a pulling means that is movable between an initial sheathing height (H) and a final sheathing height (h), wherein a film transport means is disposed between the cutting means and the film opening means, said film transport means being configured to transport the cut-off portion of film lengthwise to the film opening means, wherein the film transport means comprises a first endlessly circulating conveyor member and a second endlessly circulating conveyor member pressed against the first conveyor member, both of which can be driven in a transport direction and between which the portion of film is receivable by frictional engagement from the cutting means as far as the film opening means, wherein the first endlessly circulating conveyor member and the second endlessly circulating conveyor member connect from below the final sheathing height (h) to at least the initial sheathing height (H).

* * * * *